US011754089B2

(12) United States Patent
Riegler et al.

(10) Patent No.: US 11,754,089 B2
(45) Date of Patent: Sep. 12, 2023

(54) FAN WITH A ROTOR AND A FAN IMPELLER

(71) Applicant: ebm-papst Mulfingen GmbH & Co. KG, Mulfingen (DE)

(72) Inventors: Peter Riegler, Boxberg (DE); Dominik Bork, Bad Mergentheim (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 0 days.

(21) Appl. No.: 17/499,904

(22) Filed: Oct. 13, 2021

(65) Prior Publication Data

US 2022/0120285 A1 Apr. 21, 2022

(30) Foreign Application Priority Data

Oct. 16, 2020 (DE) ..... 10 2020 127 312.6

(51) Int. Cl.
*F04D 29/34* (2006.01)

(52) U.S. Cl.
CPC ..... *F04D 29/34* (2013.01); *F05D 2240/90* (2013.01); *F05D 2260/36* (2013.01); *F05D 2300/43* (2013.01)

(58) Field of Classification Search
CPC .. F04D 29/34; F05D 2240/90; F05D 2260/36; F05D 2300/43
USPC ..... 416/131
See application file for complete search history.

(56) References Cited

U.S. PATENT DOCUMENTS 3,461,807 A * 8/1969 Morrison ..... F04D 29/026 415/217.1
3,521,973 A * 7/1970 Schouw ..... F04D 29/023 416/185
4,676,722 A * 6/1987 Marchal ..... F04D 29/023 416/241 A (Continued)

FOREIGN PATENT DOCUMENTS

CN 1938550 A 3/2007
DE 10 2010 043 607 A1 5/2012

(Continued)

OTHER PUBLICATIONS

Extended European Search Report dated Feb. 24, 2022 in corresponding European Application No. 21196053.9.

(Continued)

*Primary Examiner* — Logan M Kraft
*Assistant Examiner* — John D Bailey
(74) *Attorney, Agent, or Firm* — Harness, Dickey & Pierce, P.L.C.

(57) ABSTRACT

A fan (1) has a rotor (10) and a fan impeller (20). The rotor (10) has a connecting portion (11) and the fan impeller (20) has a fastening portion (21). The impeller is centered relative to the rotor (10) with the fastening portion (21) on the connecting portion (11) by at least one centering element (40). The impeller is fixed to the rotor (10) by at least one fastening element (30). The fastening element (30) is a screw with a screw head (31), a threaded portion (33), and a shaft arranged between the threaded portion (33) and the screw head (31). A spacer sleeve (34) is arranged around the shaft. A thread (12) corresponding to the fastening element (30) is, respectively, formed in the connecting portion (11).

11 Claims, 5 Drawing Sheets

(56) References Cited

U.S. PATENT DOCUMENTS 5,951,197 A * 9/1999 Wu ..... F04D 29/34 403/329
6,280,132 B1 * 8/2001 Szczukowski ..... F16B 5/0258 411/107
6,352,411 B1 * 3/2002 Bucher ..... F04D 29/34 403/302
6,659,723 B2 * 12/2003 Bankstahl ..... F04D 29/263 416/185
7,331,764 B1 * 2/2008 Reynolds ..... F04D 29/388 416/223 R
7,411,310 B2 * 8/2008 Hollinger ..... H02K 7/1815 290/45
7,969,035 B2 * 6/2011 Agtuca ..... H02K 21/24 310/156.37
8,376,702 B2 * 2/2013 Gorali ..... F04D 25/088 416/220 A
2001/0046442 A1 * 11/2001 Bucher ..... F04D 25/088 416/210 R
2003/0095867 A1 * 5/2003 Bankstahl ..... F04D 29/281 416/204 R
2003/0228224 A1 * 12/2003 Lee ..... F04D 25/088 416/206
2004/0013517 A1 * 1/2004 Adrian ..... F04D 29/662 415/119
2006/0216110 A1 * 9/2006 Boote ..... F04D 29/263 403/408.1
2016/0290138 A1 * 10/2016 Kobayashi ..... F04D 29/34
2017/0122335 A1 * 5/2017 Kinzer ..... F04D 29/329

FOREIGN PATENT DOCUMENTS

WO WO-2009036915 A1 3/2009
WO WO-2012062778 A1 5/2012

OTHER PUBLICATIONS

Search report from corresponding German Application No. 10 2020 127 312.6 , dated Jul. 29, 2021.
Chinese Search Report dated Jun. 29, 2023 in corresponding Chinese Application No. 202111145448.9.
Chinese Office Action dated Jul. 1, 2023 in corresponding Chinese Application No. 202111145448.9.

* cited by examiner

FAN WITH A ROTOR AND A FAN IMPELLER

CROSS-REFERENCE TO RELATED APPLICATION

This application claims priority to German Patent Application No. 10 2020 127 312.6 filed Oct. 16, 2020. The entire disclosure of the above application is incorporated herein by reference.

FIELD

The disclosure relates to a fan with a rotor and a fan impeller, each has a flange where they are interconnected by at least one fastening element and centered relative to one another by at least one centering element.

BACKGROUND

A large number of solutions for connecting a rotor to a fan impeller of a fan are known in the prior art. These connections usually have a plurality of inserts or bushings that are fastened in a plastic part, for example the fan impeller.

Such inserts can, for example, be overmolded immediately during the manufacture of the plastic part or later pressed or glued into such a part.

The associated manufacturing process—that is, turning the bushes and inserting them into the plastic part—is correspondingly complex and therefore cost-intensive.

The disclosure is based on the object of overcoming the aforementioned disadvantages. It provides a fan with a fan impeller and a rotor that can be manufactured and installed easily and inexpensively.

SUMMARY

This object is achieved by a fan including a rotor rotatable about an axis of rotation and a connecting portion. The fan impeller has a fastening portion corresponding to the connecting portion. The fastening portion is centered on the connecting portion by at least one centering element relative to the rotor and is fixed to the rotor by at least one fastening element. The fastening element is a screw with a screw head, a threaded portion, and a shaft. The shaft is arranged between the threaded portion and the screw head. A spacer sleeve is arranged around the shaft. An outer diameter of the spacer sleeve is smaller than an outer diameter of the screw head. Thickness of the spacer sleeve is smaller, by a predetermined amount, than a thickness of the fastening portion. A thread, corresponding to the fastening element or an opening corresponding to the fastening element is, respectively, formed in the connecting portion. A through opening, corresponding to the spacer sleeve is, respectively, formed in the fastening portion. The fastening portion is also made of a deformable material, so that when the screw is screwed into the thread, the spacer sleeve is guided into the through opening. A predetermined preload force of the screw is supported via the spacer sleeve against the connecting portion. The fastening portion is clamped to the connecting portion in an area adjoining the through opening where the screw head rests against the fastening portion.

According to the disclosure, a fan is proposed with a rotor and a fan impeller. The rotor is rotatable about an axis of rotation, more particularly, rotatably mounted about the axis of rotation. It has a connecting portion, preferably as a flange or rotor flange. Also, it preferably extends substantially orthogonally to the axis of rotation. The fan impeller has a fastening portion that corresponds to the connecting portion. It is preferably embodied as an impeller flange and extends substantially orthogonally to the axis of rotation. In addition, the fan impeller, with the fastening portion on the connecting portion, is centered relative to the rotor and, in particular, relative to the axis of rotation by at least one centering element. The connecting portion or, preferably, the rotor flange is provided as a separate component or formed integrally with the rotor. Likewise, the fastening portion or, preferably, the impeller flange can be embodied as a separate component or formed integrally with the fan impeller. The fan impeller, with the fastening portion on the connecting portion, is fixed to the rotor by at least one fastening element. The fan can also have additional components and, in particular, a stator which, together with the rotor, forms an electric motor for rotationally driving the fan impeller about the axis of rotation. According to the disclosure, the fastening element or the at least one fastening element is, respectively, a screw with a screw head, a threaded portion, and a shaft arranged between the threaded portion and the screw head. A spacer sleeve is arranged around the shaft. The spacer is preferably held freely on the shaft in its rotation around the shaft. The screw is therefore a screw with a so-called partial thread.

According to the disclosure, the spacer sleeve has an outer diameter that is smaller than an outer diameter of the screw head. Thus, the screw head preferably protrudes beyond the outer diameter of the spacer sleeve and, in an assembled state, up to the fastening portion. The spacer sleeve has a thickness or height that is smaller, by a predetermined amount, than a thickness of the fastening portion. Thus, the screw head first comes to rest against the fastening portion during assembly. Upon being screwed in, and, as screwing continues, it is able to deform at least minimally and press against the connecting portion before the screw head presses the spacer sleeve against the connecting portion in the assembled state. A thread corresponding to the fastening element is respectively formed in the connecting portion. A through opening, corresponding to the spacer sleeve, is respectively formed in the fastening portion. Instead of a thread, a corresponding opening or bore can also be provided as a passage into which a thread is grooved or cut and thus formed by a suitable screw when the screw is screwed in. Accordingly, instead of a thread, an opening or bore corresponding to the associated fastening element can also be provided. Therefore, if a plurality of fastening elements are provided, then for each fastening element there is a thread or opening in the connecting portion and a through opening in the fastening portion. The fastening portion is also made of a characteristically deformable material. Thus, when the screw is screwed into the thread, the spacer sleeve is guided into the through opening or transported and, in particular, tightened by the screwing. A predetermined preload force of the screw is supported, via the spacer sleeve, against the connecting portion. Also, the fastening portion is clamped to the connecting portion in an area adjoining the through opening where the screw head rests against the fastening portion. During clamping, the characteristically deformable material can be plastically or elastically deformed, i.e., reversibly or irreversibly.

This establishes the connection between the rotor and the fan impeller by screwing the connecting portion to the fastening portion. A sleeve or spacer sleeve is arranged on the screw used for the screw connection. When the screw with the sleeve, arranged thereon, is screwed into the thread or opening provided for this purpose, a preload force of the screw or for the screw is supported by the sleeve. The fastening portion is supported by the area of the fastening portion adjoining the sleeve that is clamped to the connecting portion. The fan impeller or the fastening portion has a height or thickness that is preferably only slightly greater than the height or thickness of the sleeve. Thus, the fastening portion is minimally deformed by a resulting minimal oversize relative to the sleeve during screwing-in and is pressed or clamped against the connecting portion.

Through the selection of the size of the screw head, the outer diameter of the sleeve, and a diameter of the through opening or of an annular surface around the sleeve against which the screw head rests on the connecting portion in the assembled state, a predetermined clamping force or surface pressure can be exerted on the fastening portion that is sufficient to ensure that the fastening portion and connecting portion or fan impeller and rotor are connected in a predetermined manner. The sleeve prevents the screw preload from diminishing over time due to creeping of the material of the fan impeller or the fastening portion. At the same time, this compensates for tolerances between the fastening portion and the connecting portion.

Accordingly, in one advantageous variant, the thickness of the spacer sleeve and the thickness of the fastening portion and/or the outer diameter of the spacer sleeve, an inner diameter of the corresponding through opening, and an outer diameter of the screw head are coordinated with one another. Thus, when the screw is screwed into the thread with the predetermined preload force, the fastening portion is pressed against the connecting portion in a predetermined manner and preferably with a predetermined surface pressure.

The outer diameter of the spacer sleeve and the inner diameter of the through opening can also be embodied as a fit and, in particular, as a clearance or transition fit.

An annular and plateau-like projection can also be provided around a respective through opening on a surface or side of the fastening portion facing the connecting portion. The projection can rest directly against the connecting portion and maintain the remaining areas of the fastening portion at a predetermined distance from the connecting portion.

Furthermore, a refinement is advantageous where the fastening portion and/or the fan impeller are integrally formed with one another from a plastic.

In addition, the spacer sleeve can be rotated relative to the screw or relative to the shaft of the screw. Additionally or alternatively, it is advantageous if the spacer sleeve is held by the screw on the shaft. Thus, the spacer sleeve cannot separate or loosen from the screw but can be rotated on the screw as required.

In addition to the fastening portion, the spacer sleeve can also be made of a characteristically deformable material. Thus, when the screw is screwed into the thread, the outer diameter of the spacer sleeve is increased with the predetermined preload force and deformed as it presses against the fastening portion. For this purpose, the spacer sleeve can be made of aluminum or another comparatively soft alloy, for example. If the screw is to still be rotatable relative to the spacer sleeve and/or remain separable therefrom, an inner diameter of the spacer sleeve can be selected such that an inner surface of the spacer sleeve facing the screw is not pressed against the screw as a result of the predetermined deformation or the predetermined preload force.

In order to improve the hold between the spacer sleeve and the surrounding area of the fastening portion, the spacer sleeve has a knurling on an outer surface pointing in the radial direction toward the fastening portion in the assembled state. In the simplest case, the knurling can also be instantiated in the form of one or more circumferential impressions.

A plurality of fastening elements and/or a plurality of centering elements are distributed around the axis of rotation in the circumferential direction. In particular, the fastening elements are distributed at regular intervals in the circumferential direction around the axis of rotation. Thus, the forces applied by the fastening elements to the fastening portion and the connecting portion are introduced uniformly into same and result in uniform clamping.

In one advantageous variant, at least one centering element is a centering projection arranged or formed on the fastening portion. It extends through a corresponding centering opening formed by the connecting portion. The centering projection can be formed integrally with a fastening portion or fan impeller made of plastic, particularly by an injection molding process. Thus, it is possible, in principle for the at least one centering element to be a centering projection that is instead arranged or formed on the connecting portion and extends through a corresponding centering opening formed by the fastening portion.

In order to be able to provide good centering in a simple manner centering projections, a plurality of centering elements, each embodied as a centering projection, are provided. They taper conically and/or are star-shaped in cross section to their longitudinal axis. The corresponding centering openings can be round or, alternatively, also star-shaped, so that the centering projections can lie extensively in a predetermined manner.

If a plurality of centering elements are provided, they can be distributed asymmetrically around the axis of rotation in the circumferential direction. Thus, the fastening portion and the connecting portion are, or must be arranged, in a predetermined orientation that is encoded by the asymmetric distribution. In particular, the centering elements can be arranged such that the distribution reduces an imbalance or original imbalance of the fan impeller and preferably of the entire fan.

Particularly on a side that is mutually facing during assembly, the respective through opening and/or the spacer sleeve have a lead-in slope or are beveled. Thus, the migration of the spacer sleeve into the through opening is simplified.

The features disclosed above can be combined as required, provided this is technically possible and they do not contradict one another.

Further areas of applicability will become apparent from the description provided herein. The description and specific examples in this summary are intended for purposes of illustration only and are not intended to limit the scope of the present disclosure.

DRAWINGS

Other advantageous further developments of the disclosure are identified in the dependent claims or presented below together with the description of the preferred embodiment of the disclosure with reference to the figures.

Figure 5A:
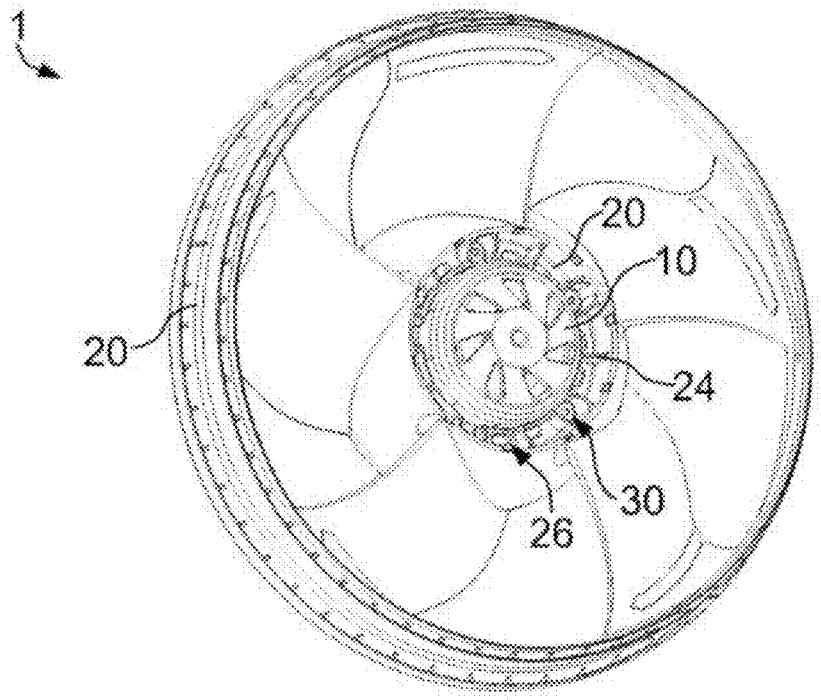

FIG. 5*a* is a front perspective view of a fan.

Figure 5B:
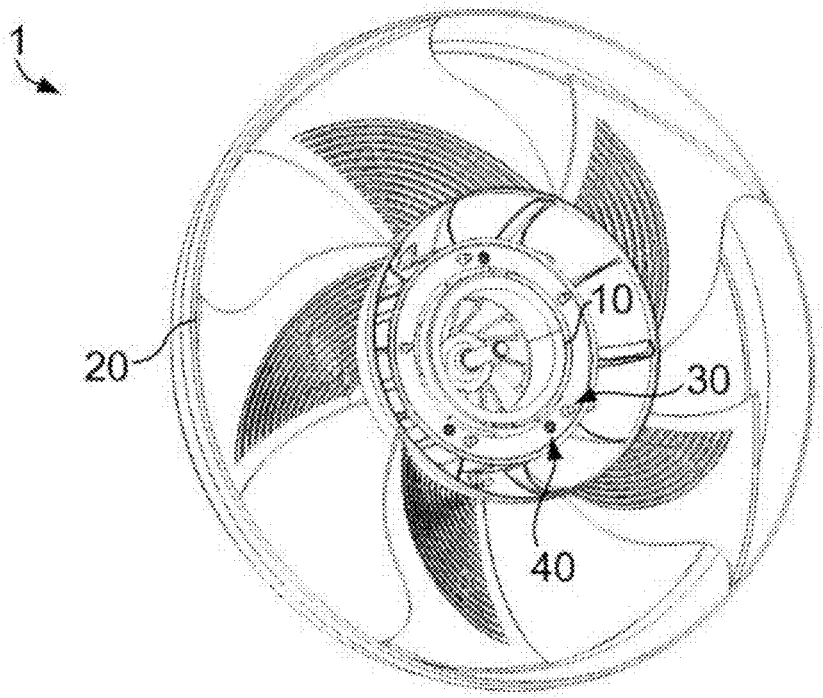

FIG. 5*b* is a rear perspective view of a fan.

Figure 6A:
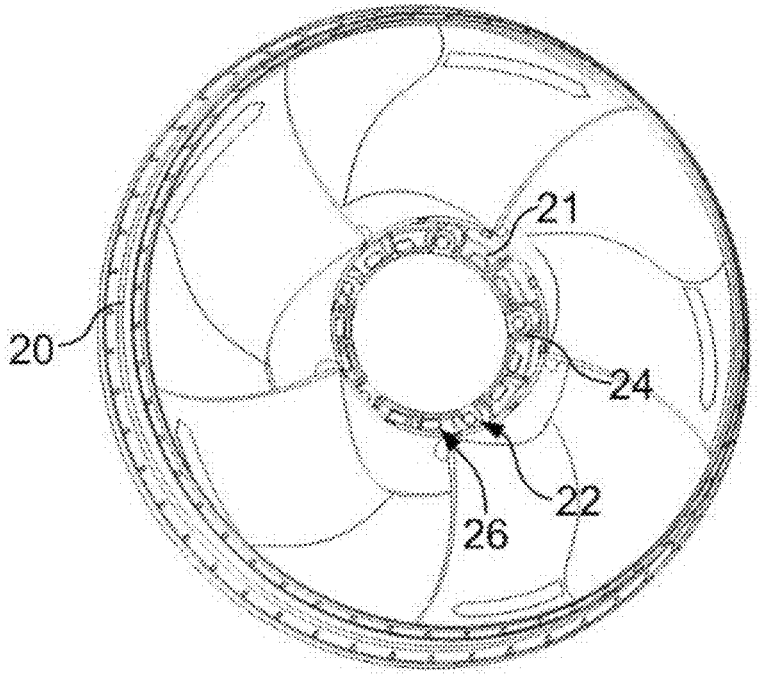

FIG. 6*a* is a front perspective view of a fan impeller.

Figure 6B:
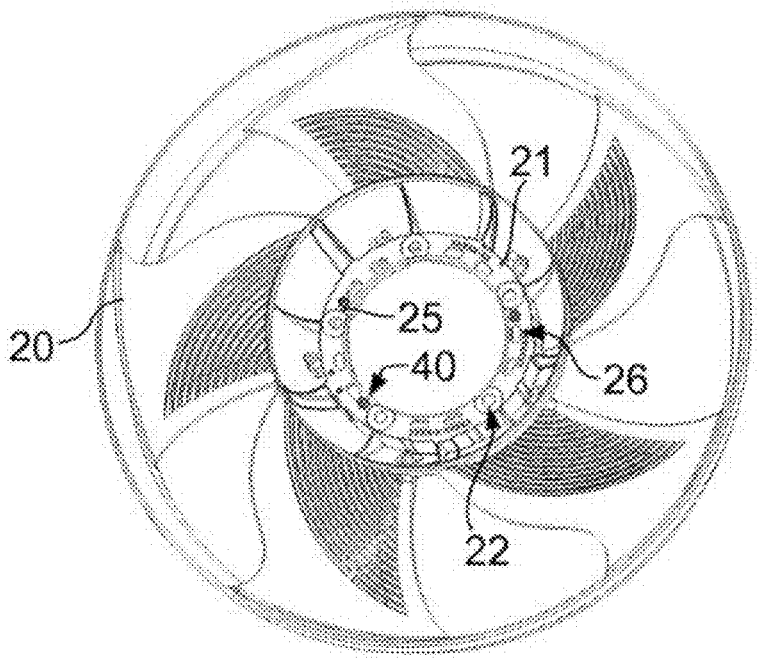

FIG. 6*b* is a rear perspective view of a fan impeller.

Figure 7:
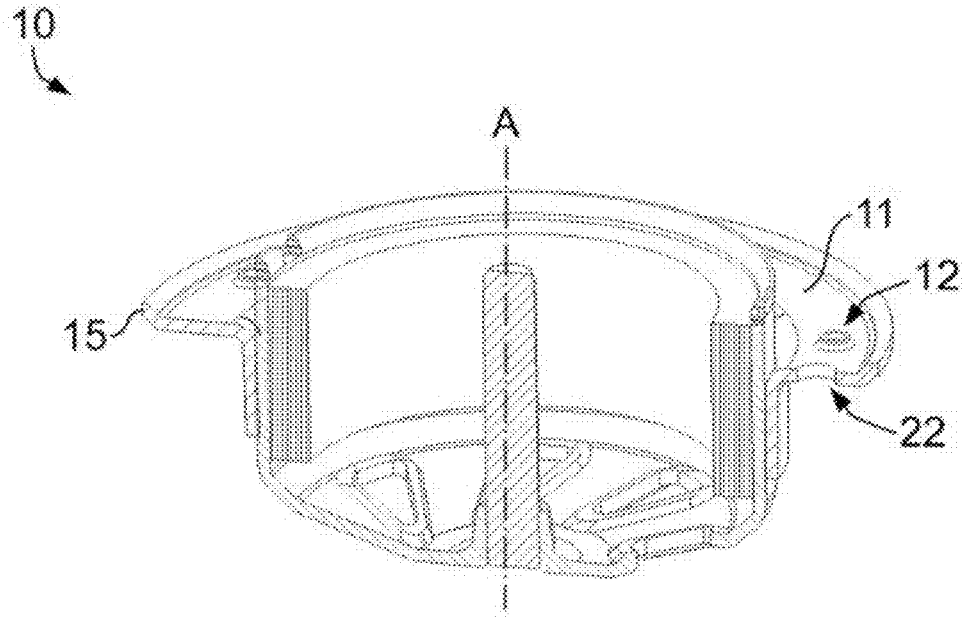

FIG. 7 is a cross-section view through a rotor.

Figure 8:
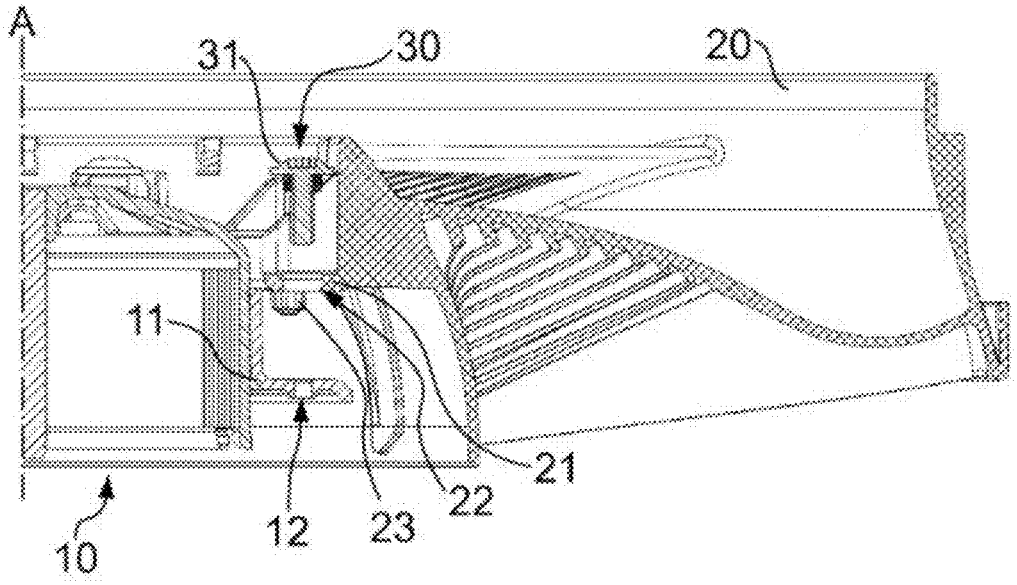

FIG. 8 is a cross-section through a fan.

DETAILED DESCRIPTION

The figures are schematic examples. The same reference symbols in the figures indicate same functional and/or structural features.

Figure 1:
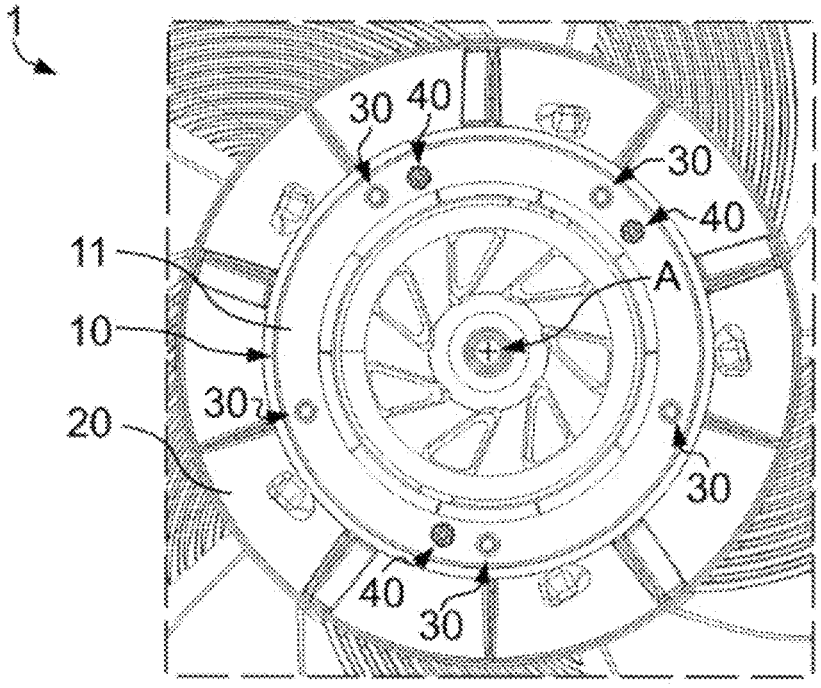
FIG. 1 is a cross-section view of a fan.

FIG. 1 shows a fan 1, more specifically a rotor 10 and a fan impeller 20 of the fan 1, in a view from below. A connecting portion 11 that is embodied as a rotor flange is visible. The fastening portion 21, embodied here as an impeller flange, is covered by the connecting portion 11. Clearly visible, in particular, is an asymmetrical arrangement of the centering elements 40. Three centering elements 40 are distributed over the circumferential direction around the axis of rotation A. Thus, the fan impeller 20 can be arranged only in a single predetermined alignment on the rotor 10. The fastening portion 21 can be arranged only in a single predetermined alignment on the connecting portion 11. Deviating therefrom, five fastening elements 30, distributed uniformly in the circumferential direction, are provided in the present case to uniformly clamp the rotor 10 and the fan impeller 20 to one another.

Figure 2:
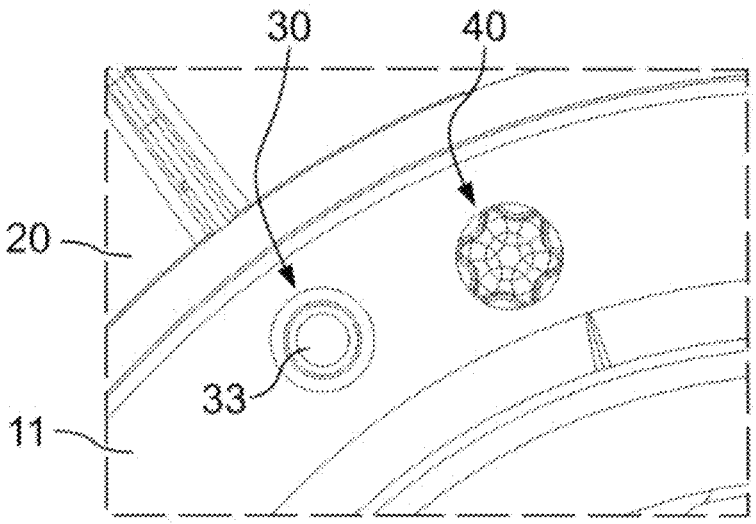
FIG. 2 is an exploded plan view of an area around a fastening element and a centering element on a fan.

An enlarged section of FIG. 1 is shown in FIG. 2. A fastening element 30 and a centering element 40 are shown directly adjacent to one another. The star-shaped cross section of the centering projection 23 can be seen from the illustration. Since this is also a view from below, the screw protrudes with its threaded portion 33 through the connecting portion 11.

Figure 3:
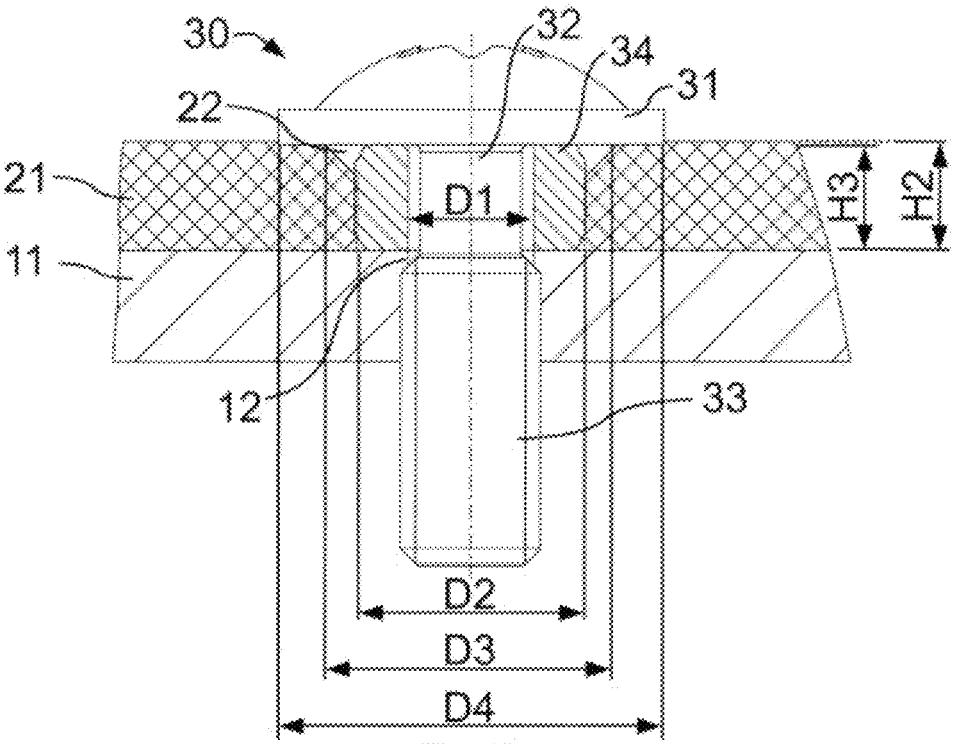
FIG. 3 is a cross-section view through a fastening portion and a connecting portion in the vicinity of a fastening element.

The sectional view of FIG. 3 shows a fastening element 30 clamping the fastening portion 21 to the connecting portion 11. The fastening element 30 is formed substantially by a screw and a spacer sleeve 34. The spacer sleeve 34 is rotatably held on the screw. The spacer sleeve 34 is held on a shaft 32 that lies between a screw head 31 and a threaded portion 33 of the screw.

The screw 30 is, particularly, a thread-forming screw that is designed to cut or furrow a thread in the opening (bore) corresponding to the screw. It is inserted with its threaded portion 33 into a thread 12 that is formed for this purpose by or in the connecting portion 11 or screwed into a hole corresponding to the screw and not yet having a thread before screwing-in. As a result of the screwing, the spacer sleeve 34 migrates into a corresponding through opening 22 in the fastening portion 21. In the present case, the outer diameter D2 of the spacer sleeve 34 corresponds substantially to the inner diameter of the through opening 22.

Because a diameter of the shaft 32 is smaller than an inside diameter D1 of the spacer sleeve 34, the latter can be freely rotated on the shaft 32 or the screw can be freely rotated relative to the spacer sleeve 34.

The thickness H2 of the fastening portion 21 is preferably only slightly greater than the thickness H1 of the spacer sleeve 32. Thus, the screw head 31 initially comes to rest against the fastening portion 21 when it is screwed in. The screw head 31 presses the fastening portion 21 against the connecting portion 11 before the preload force, that is required for the screw, is achieved through a contacting of the screw head 31 against the spacer sleeve 34 or via the spacer sleeve 34 against the connecting portion 11.

The clamping force or surface pressure applied by the screw head 31 to the fastening portion 21 is also determined by the contact surface of the screw head 31 on the fastening portion 21. The contact is annular and dependent on the outer diameter D4 of the screw head as well as on a diameter D3 that is determined by the through opening 22 and, if present, a lead-in slope of the through opening 22.

In addition, the fastening portion 21 can be deformed at least in the area of the contact surface. Thus, it additionally presses against the outer surface of the spacer sleeve 34.

Figure 4:
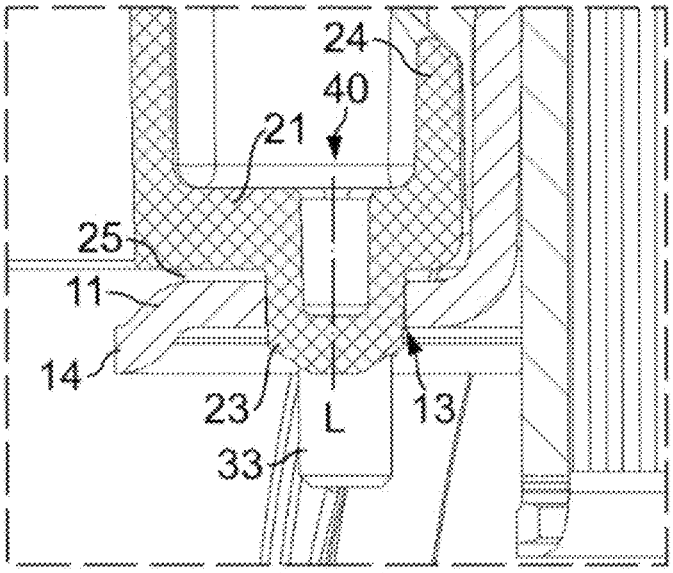
FIG. 4 is a cross-section view through a fastening portion and a connecting portion in the vicinity of a centering element.

FIG. 4 shows a section through a centering element 40 that is instantiated by a centering projection 23. It is formed by the fastening portion 21 and by a centering opening 13 that is formed by the connecting portion 11. The slightly conical centering projection 23 tapers toward its end along its longitudinal axis L starting from the fastening portion 21.

In order to enable a greater tolerance in the manufacture of the mutually facing surfaces of the connecting portion 11 and of the fastening portion 21, one or a plurality of projections 25 can be provided on one of the surfaces, as is shown in FIG. 6*b*, for example. These projections 25, which have a flat surface relative to the plane of separation between the connecting portion 11 and the fastening portion 21, can be provided adjacent to or surround a fastening element. Accordingly, the fastening portion 21 in FIG. 4 is already in its final assembly position or in its predetermined positioning relative to the connecting portion 11. Thus, a gap between them is nevertheless discernible but is predetermined by the plateau-like projection 25 formed by the fastening portion 21.

It can also be seen in FIG. 4 that the connecting portion 11 forms a circumferential fold 14 that stiffens the connecting portion 11. Furthermore, stiffening ribs 24 are included on the fastening portion 21 or the fan impeller 20, as is shown for example in FIGS. 5*a* and 6*a*. The ribs 24 can also extend around the areas around the fastening elements 30 or the screw heads 31.

Therefore, neither the connecting portion 11 nor the fastening portion 21 need be a simple flange that extends exclusively on one plane.

FIGS. 5*a* and 5*b* each show a perspective representation of a fan 1. More particularly of the fan impeller 20 and rotor 10, according to FIGS. 1, 2, and 4. FIG. 5*a* shows a view from above and FIG. 5*b* shows a view from below.

As explained previously, FIG. 5*a* shows that the fan impeller 30 has a multiplicity of stiffening ribs 24 that reinforce the fastening portion 21. The reinforcing ribs 24 directly encircle the screw heads 31. Recesses 26 are provided in the fastening portion 21 for the purpose of weight reduction.

In FIGS. 6*a*, and 6*b*, only the fan impeller 20 without the rotor 10 is shown in perspective view from above and below. In particular, FIG. 6*a* shows the plateau-like projections 25 that define the parting plane between the fastening portion 21 and the connecting portion 11. The projections 25 are arranged in a ring around a through opening 22. The clamping effect or force, via the screw heads 31, is thus produced or transferred exclusively via the plateau-like projections 25.

FIG. 7 shows a rotor 10 isolated and in section. A round centering opening 12 can be seen that includes a centering projection 22 that receives a star-shaped cross section. It can also be seen that the thread 12 is embodied as an internal thread in an opening or as a bore or passage through a thread-forming screw. The thread 12 extends with an edge out of the surrounding plane of the connecting portion 11.

In FIG. 8, the rotor 10 and the fan impeller 20 can be seen before or during their assembly. The fastening portion 21 is guided onto the connecting portion 11 and brought into the predetermined positioning or angular position. This enables the centering projections 23 to engage in the corresponding centering openings 13.

If the fastening portion 21 and the connecting portion 11 are moved further toward one another, the fastening portion 21 can be guided by the centering elements 40 into position. Subsequently or at the same time, the fastening elements 30 can be inserted and their threaded portion 33 can be screwed into the corresponding thread 12. As a result of the screwing-in, more particularly screwing-home, the spacer sleeves 34 are introduced into the corresponding through openings 22 and preferably pressed in. Then the screw head 31 first comes to rest against the fastening portion 21 and presses same against the connecting portion 11. The screw head 31 comes into contact with the spacer sleeve 34 through a minimal deformation of the fastening portion 21. While the screw head 31 is supported by the spacer sleeve 34 on the connecting portion 11, it builds up a preload force that was predetermined for a screw.

The disclosure is not limited in its execution to the abovementioned preferred exemplary embodiments. Rather, a number of variants are conceivable that make use of the illustrated solution even in the form of fundamentally different embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fan comprising:

a rotor rotatable about an axis of rotation and has a connecting portion, a fan impeller has a fastening portion corresponding to the connecting portion and, the fastening portion is centered on the connecting portion, by at least one centering element relative to the rotor, the at least one centering element is an asymmetrical arrangement, the fastening portion is fixed to the rotor by at least one fastening element and the fan impeller arranged in a single predetermined arrangement on the rotor by the centering element;

the fastening element is a screw with a screw head, a threaded portion, and a shaft, the shaft is arranged between the threaded portion and the screw head, a spacer sleeve is arranged around the shaft, an outer diameter of the spacer sleeve is smaller than an outer diameter of the screw head;

and thickness of the spacer sleeve is smaller, by a predetermined amount, than a thickness of the fastening portion, a thread, corresponding to the fastening element or an opening corresponding to the fastening element is, respectively, formed in the connecting portion, and a through opening, corresponding to the spacer sleeve is, respectively, formed in the fastening portion, and the fastening portion is also made of a deformable material, so that when the screw is screwed into the thread, the spacer sleeve is guided into the through opening, a predetermined preload force of the screw is supported via the spacer sleeve against the connecting portion, and the fastening portion is clamped to the connecting portion in an area adjoining the through opening where the screw head rests against the fastening portion.

2. The fan as set forth in claim 1, wherein the thickness of the spacer sleeve and the thickness of the fastening portion, and/or the outer diameter of the spacer sleeve, an inner diameter of the corresponding through opening, and an outer diameter of the screw head are coordinated with one another in such a way that, when the screw is screwed into the thread, the fastening portion is pressed in a predetermined manner against the connecting portion with the predetermined preload force.

3. The fan as set forth in claim 1, wherein the fastening portion and/or the fan impeller are made of a plastic.

4. The fan as set forth in claim 1, wherein the spacer sleeve is rotatable relative to the screw and/or held by the screw on the shaft.

5. The fan as set forth in claim 1, wherein the spacer sleeve is made of a deformable material, so that when the screw is screwed into the thread, the outer diameter of the spacer sleeve is increased with the predetermined preload force and deformed as it presses against the fastening portion.

6. The fan as set forth in claim 1, wherein the spacer sleeve has a knurling on an outer surface pointing in the radial direction toward the fastening portion.

7. The fan as set forth in claim 1, wherein a plurality of fastening elements and/or a plurality of centering elements are distributed in the circumferential direction around the axis of rotation.

8. The fan as set forth in claim 1, wherein the centering element is a centering projection that is arranged or formed on the fastening portion and extends through a corresponding centering opening formed by the connecting portion, or wherein the centering element is a centering projection that is arranged or formed on the connecting portion and extends through a centering opening formed by the corresponding fastening portion.

9. The fan as set forth in claim 1, wherein a plurality of centering elements, each embodied as a centering projection, taper conically and/or are star-shaped in a cross section to their longitudinal axis (L).

10. The fan as set forth in claim 1, wherein a plurality of centering elements are distributed asymmetrically around the axis of rotation in the circumferential direction, so that the fastening portion and the connecting portion are arranged in a predetermined orientation that is encoded by the asymmetrical distribution.

11. The fan as set forth in claim 1, wherein the respective through opening and/or the spacer sleeve has a lead-in slope.

* * * * *